US007601105B1

(12) United States Patent
Gipson, III et al.

(10) Patent No.: US 7,601,105 B1
(45) Date of Patent: Oct. 13, 2009

(54) CABLE CROSSOVER EXERCISE APPARATUS WITH LATERAL ARM MOVEMENT

(75) Inventors: Allen Heyson Gipson, III, Colorado Springs, CO (US); Richard Allen Compton, Colorado Springs, CO (US); Gerald Daines Nelson, Colorado Springs, CO (US)

(73) Assignee: ICON IP, Inc., Logan, UT (US)

( * ) Notice: Subject to any disclaimer, the term of this patent is extended or adjusted under 35 U.S.C. 154(b) by 596 days.

(21) Appl. No.: 11/178,715

(22) Filed: Jul. 11, 2005

(51) Int. Cl.
*A63B 21/062* (2006.01)

(52) U.S. Cl. ..... 482/103; 482/138

(58) Field of Classification Search ..... 482/103, 482/138

See application file for complete search history.

(56) References Cited

U.S. PATENT DOCUMENTS

| | | | |
|---|---|---|---|
| 321,388 | A | 6/1885 | Ruesbam |
| 353,089 | A | 11/1886 | Smith |
| 372,272 | A | 10/1887 | Murphy |
| 374,496 | A | 12/1887 | Reach |
| 457,400 | A | 8/1891 | Dowd |
| 722,462 | A | 3/1903 | Smith |
| 776,824 | A | 12/1904 | Bryon, Jr. |
| 807,670 | A | 12/1905 | Grabner |
| 1,928,089 | A | 9/1933 | Blickman |
| 2,436,987 | A | 3/1948 | Bailleaux |
| 2,472,391 | A | 6/1949 | Alzibu |
| 2,977,120 | A | 3/1961 | Morris |
| 3,708,166 | A | 1/1973 | Annas |
| 4,154,441 | A | 5/1979 | Gajda |
| 4,372,553 | A | 2/1983 | Hatfield |
| 4,402,504 | A | 9/1983 | Christian |
| 4,474,370 | A | 10/1984 | Oman |
| 4,531,727 | A | 7/1985 | Pitre |
| 4,603,855 | A | 8/1986 | Sebelle |

(Continued)

FOREIGN PATENT DOCUMENTS

| | | | |
|---|---|---|---|
| DE | 4410001 | A1 | 8/1994 |

(Continued)

OTHER PUBLICATIONS

Paramount PFT-200 Functional Trainer, Paramount Fitness Corp. brochure printed Jul. 2003.*

(Continued)

*Primary Examiner*—Loan H Thanh
*Assistant Examiner*—Victor K Hwang
(74) *Attorney, Agent, or Firm*—Workman Nydegger

(57) ABSTRACT

An exercise apparatus includes a support structure having a base portion, the support structure housing a resistance assembly (e.g., including a weight stack). At least one arm assembly is mounted to the support structure. Each of the one or more arm assemblies includes: (i) an elongate member, and (ii) a mounting bracket assembly. The mounting bracket assembly is pivotally mounted to the elongate member and also pivotally mounted to the support structure at a location spaced apart from the base portion of the support structure. One pivot mount allows the elongate member to pivot up and down, while the other pivot mount allows the mounting bracket assembly (and thus the arm assembly) to pivot in and out (i.e., laterally). At least one cable extends from the resistance assembly to the at least one arm assembly.

16 Claims, 7 Drawing Sheets

U.S. PATENT DOCUMENTS

| | | | | |
|---|---|---|---|---|
| 4,632,388 | A | 12/1986 | Schleffendorf | |
| 4,635,926 | A | 1/1987 | Minkow | |
| 4,657,246 | A | 4/1987 | Salyer | |
| 4,666,151 | A | 5/1987 | Chillier | |
| 4,685,670 | A | 8/1987 | Zinkin | |
| 4,697,809 | A | 10/1987 | Rockwell | |
| 4,721,301 | A | 1/1988 | Drake | |
| 4,721,303 | A | 1/1988 | Fitzpatrick | |
| 4,733,860 | A | 3/1988 | Steffee | |
| 4,763,897 | A | 8/1988 | Yakata | |
| 4,784,384 | A | 11/1988 | Deola | |
| 4,826,157 | A | 5/1989 | Fitzpatrick | |
| 4,834,365 | A | 5/1989 | Jones | |
| 4,898,381 | A | 2/1990 | Gordon | |
| 4,900,018 | A | 2/1990 | Ish, III et al. | |
| 4,907,798 | A | 3/1990 | Burchatz | |
| 4,913,423 | A | 4/1990 | Farran et al. | |
| 4,974,838 | A | 12/1990 | Sollenberger | |
| 4,990,838 | A | 2/1991 | Kawato et al. | |
| 5,044,629 | A | 9/1991 | Ryan et al. | |
| 5,064,191 | A | 11/1991 | Johnson | |
| 5,090,694 | A | 2/1992 | Pauls et al. | |
| 5,102,121 | A | 4/1992 | Solow et al. | |
| 5,102,122 | A | 4/1992 | Piane, Jr. et al. | |
| 5,211,614 | A | 5/1993 | Henes | |
| 5,236,406 | A | 8/1993 | Webber | |
| 5,242,344 | A | 9/1993 | Hundley | |
| 5,250,013 | A | 10/1993 | Brangi | |
| D342,106 | S | 12/1993 | Campbell et al. | |
| 5,267,930 | A | 12/1993 | Henes | |
| 5,348,524 | A | 9/1994 | Grant | |
| 5,356,360 | A | 10/1994 | Johns | |
| 5,362,290 | A | 11/1994 | Huang | |
| 5,362,296 | A | 11/1994 | Wang et al. | |
| 5,417,634 | A | 5/1995 | Habing | |
| 5,429,569 | A | 7/1995 | Gunnari | |
| 5,549,530 | A | 8/1996 | Fulks | |
| 5,569,138 | A | 10/1996 | Wang et al. | |
| 5,667,465 | A | 9/1997 | McCollum et al. | |
| 5,674,167 | A | 10/1997 | Piaget et al. | |
| 5,709,638 | A | 1/1998 | Mackert et al. | |
| 5,722,921 | A | 3/1998 | Simonson | |
| 5,738,616 | A | 4/1998 | Robertson | |
| 5,800,321 | A | 9/1998 | Webber | |
| 5,897,467 | A | 4/1999 | Habing et al. | |
| 5,906,566 | A | 5/1999 | Whitcomb | |
| 5,931,767 | A | 8/1999 | Morales | |
| 5,941,807 | A | 8/1999 | Cassidy et al. | |
| 5,951,444 | A | 9/1999 | Webber | |
| 5,961,428 | A | 10/1999 | Webber | |
| 5,989,165 | A | 11/1999 | Giannelli et al. | |
| 6,036,622 | A | 3/2000 | Gordon | |
| 6,217,493 | B1 | 4/2001 | Spletzer | |
| 6,238,323 | B1 | 5/2001 | Simonson | |
| 6,267,711 | B1 | 7/2001 | Hinds | |
| 6,443,877 | B1 | 9/2002 | Hoecht et al. | |
| 6,458,061 | B2 | 10/2002 | Simonson | |
| 6,488,612 | B2 | 12/2002 | Sechrest et al. | |
| 6,491,610 | B1 | 12/2002 | Henn | |
| 6,599,223 | B2 | 7/2003 | Wang et al. | |
| 6,669,607 | B2 | 12/2003 | Slawinski et al. | |
| 6,705,976 | B1 * | 3/2004 | Piane, Jr. | 482/103 |
| 7,169,093 | B2 | 1/2007 | Simonson et al. | |
| 7,172,538 | B2 * | 2/2007 | Keiser | 482/140 |
| 7,282,016 | B2 | 10/2007 | Simonson et al. | |
| 7,396,319 | B1 * | 7/2008 | Ellis | 482/100 |
| 2003/0017918 | A1 | 1/2003 | Webb et al. | 482/94 |
| 2003/0032530 | A1 | 2/2003 | Sechrest et al. | |
| 2003/0060343 | A1 | 3/2003 | Sechrest et al. | |
| 2003/0114281 | A1 | 6/2003 | Mackert et al. | |
| 2003/0176261 | A1 | 9/2003 | Simonson | |

FOREIGN PATENT DOCUMENTS

| | | | |
|---|---|---|---|
| DE | 4331733 | | 5/1995 |
| DE | 4331733 | A1 * | 5/1995 |
| DE | 19704390 | A1 | 9/1997 |
| DE | 19801672 | A1 | 11/1998 |
| SU | 1743620 | A1 | 11/1989 |
| SU | 1586724 | | 8/1990 |
| SU | 1725744 | A3 | 4/1992 |

OTHER PUBLICATIONS

Paramount Fitness Equip., drawings for Assy. Functional Trainer, PFT-200, Apr. 2003.*

Freemotion Cable Cross Owner's Manual (Model No. GZFM60063), pp. 1-16, Printed in USA 2003, ICON Health and Fitness.

Freemotion Cable Cross Owner's Manual (Model No. GZFM60064), pp. 1-16, Printed in USA 2003, ICON Health and Fitness.

Cybex Expert Report—"Mechanical Engineering Analysis," 121 pages including tabs, Sep. 29, 2003.

Cybex Expert Report—"Supplemental Mechanical Engineering Analysis," 137 pages, Oct. 28, 2003.

Defendant Cybex International, Inc.'s Supplemental Responses to Plaintiff's Interrogatories and Document Requests, 46 pages, Sep. 29, 2003.

Defendant's [Nautilus's] Supplemental Responses to Plaintiffs First Set of Interrogatories, 45 pages, Aug. 8, 2003.

Cybex Expert Report—Letter from Michael W. Starkweather, 4 pages, Dec. 19, 2003.

Plaintiff Free Motion's Memorandum of Points and Authorities in Support of Its Motion for Partial Summary Judgment that Defendant Cybex Cannot, as a Matter of Law, Sustain Its Burden of Proving that the Asserted Claims of the Patents-in-Suit are Invalid, 229 pages including tabs, Aug. 29, 2003 [filed under seal and redacted accordingly].

Defendant Cybex's Memorandum in Support of Its Motion for Summary Judgment that the Patents-in-Suit are Invalid, and Alternative Request for Time to Do Additional Discovery of Prior Art; and Memorandum in Opposition to Plaintiff's Motion for Partial Summary Judgment that Cybex Cannot Sustain Its Burden of Proving that the Asserted Claims of the Patents-in-Suit Are Invalid, 694 pages including tabs, Sep. 29, 2003.

Plaintiff Free Motion's Reply Memorandum of Points and Authorities in Further Support of Its Motion for Partial Summary Judgment that Defendant Cybex Cannot, as a Matter of Law, Sustain Its Burden of Proving that the Asserted Claims of the Patents-in-Suit Are Invalid, 36 pages including tabs, Oct. 14, 2003.

Plaintiff Free Motion's Memorandum of Points and Authorities in Opposition to Defendant Cybex's Cross-Motion for Summary Judgment that the Patents-in-Suit Are Invalid, 47, pages including tabs, Oct. 29, 2003.

Defendant Cybex's Reply Memorandum in Support of Motion for Summary Judgment that the Patents-in-Suit Are Invalid, 180 pages including tabs, Nov. 14, 2003.

Free Motion Expert Report—"Infringement Analysis," 32 pages including tabs, Aug. 21, 2003.

Free Motion Expert Report—"Infringement Analysis," 31 pages including tabs, Dec. 11, 2003.

Plaintiff Free Motion's Memorandum of Points and Authorities in Support of Its Motion for Partial Summary Judgment of Literal Infringement of Claim 1 of the '061 Patent by Defendant Cybex's FT 360 Device, 140 pages including tabs, May 9, 2003 [filed under seal and redacted accordingly].

Corrigendum to Plaintiff Free Motion's Memorandum of Points and Authorities in Support of Its Motion for Partial Summary Judgment of Literal Infringement of Claim 1 of the '061 Patent by Defendant Cybex's FT 360 Device, 6 pages including tabs, May 12, 2003 [filed under seal and redacted accordingly].

Plaintiff Free Motion's (1) Reply Memorandum in Further Support of Its Motion for Partial Summary Judgment of Literal Infringement of Claim 1 of the '061 Patent by Defendant Cybex's FT 360 Device and (2) Memorandum of Points and Authorities in Opposition to Defendant Cybex's Cross-Motion for Partial Summary Judgment of No Literal Infringement of Claim 1 of the '061 Patent by Cybex's FT 360 Device, 15 pages, Jul. 2, 2003 [filed under seal and redacted accordingly].

Defendant Cybex's Reply Memorandum in Support of Motion for Partial Summary Judgment of No Infringement, 18 pages, Jul. 8, 2003.

Plaintiff Free Motion's Memorandum of Points and Authorities in Support of Its Motion for Partial Summary Judgment of Literal Infringement of Claim 1 of the '061 Patent by Defendants' Freedom Trainer Device, 172 pages including tabs, Aug. 1, 2003.

Defendants' Memorandum in Support of Cross-Motion for Partial Summary Judgment of Non-Infringement Literally and in Opposition to Free Motion's Motion for Partial Summary Judgment of Literal Infringement of Claim 1 of the '061 patent, 29 pages, Sep. 30, 2003.

The Nautilus Group, Inc.'s Request for Judicial Notice in Support of its Reply to Cross-Motion for Partial Summary Judgment of Noninfringement Literally of Claim 1 of the '061 Patent, 39 pages including tabs, Nov. 14, 2003.

Declaration of David M. Jacobson in Support of Nautilus's Cross-Motion for Partial Summary Judgment of Non-Infringement Literally and in Opposition to Free Motion's Motion for Partial Summary Judgment of Literal Infringement of Claim 1 of the '061 Patent, 13 pages including tabs, Sep. 30, 2003.

Declaration of Greg Webb in Support of Defendants' Cross-Motion of Non-Infringement and in Opposition to Free Motion's Motion for Partial Summary Judgment of Literal Infringement of Claim 1 of the '061, 25 pages including tabs, Sep. 30, 2003.

Plaintiff Free Motion's Reply Memorandum of Points and Authorities in Further Support of Its Motion for Partial Summary Judgment of Literal Infringement of Claim 1 of the '061 Patent by Defendants' Freedom Trainer Device, 55 pages including tabs, Oct. 15, 2003.

Plaintiff Free Motion's Memorandum of Points and Authorities in Opposition to Defendants' Cross-Motion for Partial Summary Judgment No Literal Infringement of Claim 1 of the '061 Patent by Defendants' Freedom Trainer Device, 23 pages, Nov. 3, 2003.

The Nautilus Group, Inc.'s Reply to Cross-Motion for Partial Summary Judgment of Noninfringement Literally of Claim 1 of the '061 patent, 12 pages, Nov. 18, 2003.

Plaintiff Free Motion's Memorandum of Points and Authorities in Support of Its Rule 60(b)(1) Motion for Relief From the Court's Order of Dec. 30, 2003, 46 pages including tabs, Feb. 4, 2004.

The Nautilus's Opposition to Free Motion's Rule 60(b)(1) Motion for Relief From the Court's Order of Dec. 30, 2003, 11 pages, Feb. 19, 2004.

Defendant Cybex's Memorandum in Opposition to Plaintiff's Rule 60(b)(1)[sic] Motion for Relief From the Court's Order of Dec. 30, 2003, 83 pages including tabs, Feb. 23, 2004.

Plaintiff Free Motion's Reply Memorandum of Points and Authorities in Further Support of Its Rule 60(b)(1) Motion for Relief from the Court's Order of Dec. 30, 2003, 10 pages, Mar. 5, 2004.

The Nautilus Group, Inc.'s Memorandum in Support of Motion for Summary Judgment of Non-Infringement Literally and Under the Doctrine of Equivalents, 13 pages, Jan. 27, 2004.

Declaration of David M. Jacobson in Support of the Nautilus Group Inc.'s Motion for Summary Judgment of Non-Infringement Literally and Under the Doctrine of Equivalents, 46 pages including tabs, Jan. 27, 2004.

Plaintiff Free Motion's Opposition to Nautilus's Motion for Summary Judgment of Noninfringement, 158 pages including tabs, Mar. 8, 2004.

Declaration of Mark A. Lewis in Support of Plaintiff Free Motion's Opposition to Nautilus's Motion for Summary Judgment of Noninfringement Under the Doctrine of Equivalents, 13 pages, Mar. 8, 2004.

The Nautilus Group, Inc.'s Reply to Motion for Summary Judgment of Non-Infringement Literally and Under the Doctrine of Equivalents, 12 pages, Mar. 25, 2004.

Second Declaration of David M. Jacobson in Support of the Nautilus Group Inc.'s Motion for Summary Judgment of Non-Infringement Literally and Under the Doctrine of Equivalents, 8 pages including tabs, Mar. 25, 2004.

Defendant Cybex's Memorandum in Support of Motion for Complete Summary Judgment of Non-Infringement Literally and Under the Doctrine of Equivalents, 44 pages including tabs, Feb. 4, 2004.

Plaintiff Free Motion's Memorandum in Opposition to Cybex's Motion for Summary Judgment of Non-Infringement, 184 pages including tabs, Mar. 15, 2004.

Declaration of Mark A. Lewis in Support of Plaintiff Free Motion's Opposition to Cybex's Motion for Summary Judgment of Non-Infringement, 16 pages, Mar. 15, 2004.

Objection to Order Granting the Nautilus Group, Inc.'s Motion for Summary Judgment of Non-Infringement Literally and Under the Doctrine of Equivalence, 20 pages including tabs, Jun. 7, 2004.

Objection to Cybex's Proposed Summary Judgment Dismissing Plaintiff's Claims Against Defendant Cybex and Proposed Findings, Conclusions and Order Granting Cybex's Motion for Complete Summary Judgment of Non-Infringement, 20 pages including tabs, Jun. 7, 2004.

Cybex's Response to Plaintiff's Objection to Cybex's Proposed Order and Summary Judgment, 8 pages, Jun. 9, 2004.

Amended Objection to Proposed Order Granting The Nautilus Group, Inc.'s Motion for Summary Judgment of Non-Infringement Literally and Under the Doctrine of Equivalence, 7 pages, Jun. 10, 2004.

Response to Amended Objection to Proposed Order Granting the Nautilus Group, Inc.'s Motion for Summary Judgment of Non-Infringement Literally and Under the Doctrine of Equivalents, 5 pages, Jun. 11, 2004.

Memorandum Opinion & Order Re: Free Motion and Cybex's Cross-Motions for Summary Judgment as to Infringement of Claim One of Patent '061; and Free Motion and Nautilus' Cross Motions for Summary Judgment as to Infringement of Claim One of Patent '061, 20 pages, Dec. 30, 2003.

Order Denying Defendant Cybex's Motion for Summary Judgment That the Patents in Suit are Invalid, 5 pages, Apr. 15, 2004.

Order Denying Plaintiff Free Motion's Rule 60(b)(1) Motion for Relief From the Court's Order of Dec. 30, 2003, 5 pages, Apr. 15, 2004.

Order Denying Plaintiff Free Motion's Motion for Partial Summary Judgment That Defendant Cybex Cannot, as a Matter of Law, Sustain Its Burden of Proving that the Asserted Claims of the Patents in Suit are Invalid, 5 pages, Apr. 15, 2004.

Order Re: Defendants' Motion for Summary Judgment, 10 pages, Aug. 10, 2004.

Stipulation and Final Judgment, 6 pages, Aug. 31, 2004.

Plaintiff's Supplemental Responses to Defendant's First Set of Interrogatories, 11 pages, Oct. 21, 2002.

Plaintiff Ground Zero's Supplemental Initial Disclosures, 7 pages, Oct. 7, 2002.

Defendant's Objection to Plaintiff's First Set of Interrogatories, 4 pages, Sep. 6, 2002.

Defendant's Initial Disclosure Under Fed.R.Civ.P. 26(a)(1), 8 pages, Jul. 31, 2002.

Plaintiff Ground Zero's Initial Disclosures, 5 pages, Jul. 31, 2002.

Plaintiff's Answers to Defendant's First Set of Interrogatories, 19 pages, Jul. 30, 2002.

Plaintiff Free Motion's First Supplemental Responses and Objections to Defendants' First Set of Interrogatories (Interrogatory Nos. 1 and 6), 36 pages, Aug. 5, 2003.

Defendant's Responses to Plaintiff's First Set of Interrogatories, 17 pages, Jul. 9, 2003.

Plaintiff Free Motion's Responses and Objections to Defendants' First Set of Interrogatories, 17 pages, Jun. 27, 2003.

Defendants' Fed.R.Civ.P. 26(a) Initial Disclosures, 3 pages, Jun. 10, 2003.

Rule 26(a) Initial Disclosures [Free Motion], 4 pages, Jun. 9, 2003.

Defendant's Supplemental Responses and Objections to Plaintiff's First Set of Interrogatories, 6 pages, Mar. 19, 2003.

Plaintiff's Third Supplemental Responses to Defendant's First Set of Interrogatories, 9 pages, Feb. 28, 2003.

Free Motion's Responses to Defendant's Second Set of Interrogatories, 28 pages, Feb. 18, 2003.
Defendant's Responses and Objections to Plaintiff's Second Set of Interrogatories, 15 pages, Feb. 11, 2003.
Plaintiff's Second Supplemental Responses to Defendant's First Set of Interrogatories, 14 pages, Feb. 7, 2003.
Supplemental Responses and Objections to Nautilus' First Set of Interrogatories to Free Motion (No. 7), 7 pages, Jan. 28, 2004.
Supplemental Rule 26(a) Initial Disclosures [Free Motion], 5 pages, Jan. 28, 2004.
Responses and Objections to Nautilus' Second Set of Interrogatories to Free Motion, 18 pages, Jan. 21, 2004.
Deposition of Stewart L. Gitler, 75 pages, Jun. 3, 2003.
Deposition of Howard Flaxman, 60 pages, Jun. 4, 2003.
Deposition of Roy Richard Simonson, vol. I, 82 pages, Mar. 10, 2003.
Deposition of Roy Richard Simonson, vol. II, 74 pages, Mar. 11, 2003.
Deposition of Roy Richard Simonson, vol. III, 78 pages, Mar. 12, 2003.
Deposition of William Dalebout, 83 pages, Mar. 13, 2003.
Deposition of Tom Neppl, 39 pages, Mar. 4, 2003.
Deposition of Rich A. Compton, 42 pages, Mach 3, 2003.
Plaintiff Free Motion's Reply to the Amended Counterclaim of Defendant Cybex, 7 pages, Dec. 2, 2002.
Second Amended Complaint of Patent Infringement (Jury Trial Demanded), 35 pages with tabs, Nov. 8, 2002.
Amended Answer, Affirmative Defenses and Counterclaims of the Nautilus Group, Inc. and Nautilus Human Performance Systems, Inc., 9 pages, Sep. 11, 2003.
Plaintiff Free Motion's Reply to the Amended Answer, Affirmative Defenses and Counterclaims of the Nautilus Group, Inc. and Nautilus Human Performance Systems, Inc., 8 pages, Oct. 14, 2003.
Amended Complaint for patent Infringement (Jury Trial Demanded), 35 pages with tabs, Oct. 30, 2002.
Amended Answer of Defendant Cybex International, Inc. to Amended Complaint of Patent Infringement and Amended Counterclaim to Plaintiff's Amended Complaint, 76 pages including tabs, Nov. 13, 2002.
Brief for Appellant Free Motion Fitness, Inc., 110 pages, Dec. 6, 2004.
Brief of Defendant—Appellee Cybex International, Inc., 80 pages, Jan. 14, 2005.
Brief of Appellees The Nautilus Group, Inc., et al. 45 pages, Jan. 18, 2005.
Reply Brief for Appellant Free Motion Fitness, Inc., 45 pages, Feb. 4, 2005.
Joint Appendix (vol. I of II—pp. A1 to A1928), 466 pages, Feb. 11, 2005.
Joint Appendix (vol. II of II—pp. A1956 to A3991), 444 pages, Feb. 11, 2005.
Notice of Entry of Judgment Accompanied by Opinion, 28 pages, Sep. 16, 2005.
Cybex International, Inc.'s Combined Petitions for Panel Rehearing and Rehearing En Banc, 48 pages, Sep. 28, 2005.
Petition for Panel Rehearing and Rehearing En Banc of Defendants-Appellees The Nautilis Group, Inc. (f/k/a/ Direct Focus, Inc.) and Nautilus Human Performance Systems, Inc., 48 pages, Sep. 29, 2005.
Judgment (Issued as a Mandate), 28 pages, Nov. 10, 2005.
Ground Zero, *Strength Training Equipment*, Owner's Manual, upon information and belief, available at least as early as Jan. 2001 (80 pages (excluding section dividers)).
New Product Introductions for 2002, upon information and belief, available at least as early as Jun. 9, 2005, available at http://www.fitnessmanagement.com/FM/tmpl/genPage.asp?p=/information/articles/library/features/0102features-1.html.
Paramount Functional Trainer PFT-200, upon information and belief, available at least as early as Jul. 1, 2004, available at http://www.paramountfitness.com/showroom/pft/page_pft.html.
Office Action dated Apr. 25, 2000 from U.S. Appl. No. 09/395,194 (4 pages).
Office Action dated May 9, 2000 from U.S. Appl. No. 09/395,194 (5 pages).
Office Action dated Nov. 8, 2000 from U.S. Appl. No. 09/395,194 (5 pages).
Examiner's Interview Summary from U.S. Appl. No. 09/395,194 (1 page).
Notice of Allowance from U.S. Appl. No. 09/395,194 (3 pages).
Office Action dated Dec. 18, 2001 from U.S. Appl. No. 09/864,246 (4 pages).
Notice of Allowability from U.S. Appl. No. 09/864,246 (3 pages).
Notice of Allowance from U.S. Appl. No. 09/864,246 (2 pages).
Issue Notification dated Sep. 12, 2002 from U.S. Appl. No. 09/864,246 (2 pages).
Office Action dated Dec, 31, 2002 from U.S. Appl. No. 10/261,546 (7 pages).
Office Action dated Aug. 13, 2003 from U.S. Appl. No. 10/261,546 (6 pages).
Notice of Allowance dated Mar. 9, 2004 from U.S. Appl. No. 10/261,546 (6 pages).
Office Action dated Jul. 14, 2004 from U.S. Appl. No. 10/261,546 (10 pages).
Examiner's Interview Summary dated Oct. 14, 2004 from U.S. Appl. No. 10/261,546 (3 pages).
Office Action dated Feb. 18, 2005 from U.S. Appl. No. 10/261,546 (9 pages).
Examiner's Interview Summary dated Nov. 2, 2005 from U.S. Appl. No. 10/261,546 (2 pages).
Office Action dated Nov. 2, 2005 from U.S. Appl. No. 10/261,546 (8 pages).
Office Action dated Jun. 9, 2006 from U.S. Appl. No. 10/261,546 (7 pages).
Examiner's Interview Summary dated Aug. 1, 2006 from U.S. Appl. No. 10/261,546 (2 pages).
Notice of Abandonment from U.S. Appl. No. 10/261,546 (3 pages).
Petition Decision dated Dec. 4, 2006 from U.S. Appl. No. 10/261,546 (1 page).
Office Action dated Dec. 12, 2006 from U.S. Appl. No. 10/261,546 (9 pages).
Examiner's Interview Summary dated May 18, 2007 from U.S. Appl. No. 10/261,546 (2 pages).
Notice of Allowance dated May 18, 2007 from U.S. Appl. No. 10/261,546 (6 pages).
Issue Notification dated Sep. 26, 2007 from U.S. Appl. No. 10/261,546 (1 page).
Office Action dated Jul. 11, 2005 from U.S. Appl. No. 10/358,993 (12 pages).
Examiner's Interview Summary dated Jun. 27, 2006 from U.S. Appl. No. 10/358,993 ( 1 pages).
Examiner's Interview Summary dated Sep. 28, 2006 from U.S. Appl. No. 10/358,993 (1 page).
Notice of Allowance dated Sep. 28, 2006 from U.S. Appl. No. 10/358,993 (6 pages).
Issue Notification dated Jan. 10, 2007 from U.S. Appl. No. 10/358,993 (1 page).
Catalog of Gymnastic Apparatus, Narragansett Machine Company, Copyright 1925, p. 23.
Product brochure for Cybex International, Inc., *The Cybex FT 360 Functional Trainer*, Copyright 2000.
Website for Cybex, Jun. 7, 2001.
"Cybex:*A passion for human performance*" FT 360 Functional Trainer Owner's Manual, Jun. 2000.
U.S. Appl. No. 09/395,194, mailed date May 11, 2007, Issue Notification—U.S. Appl. No. 09/395194 (copy attached).
U.S. Appl. No. 11/627,322, Apr. 30, 2008, Office Action—U.S. Appl. No. 11/627,322 (copy attached).
U.S. Appl. No. 11/627,322, Jan. 14, 2009 Notice of Allowance—U.S Appl. No. 11/627,322 (copy attached).

* cited by examiner

CABLE CROSSOVER EXERCISE APPARATUS WITH LATERAL ARM MOVEMENT

RELATED APPLICATION

The present application claims the benefit of a U.S. Provisional Patent Application Ser. No. 60/692,412 filed Jun. 21, 2005 and entitled "CABLE CROSSOVER EXERCISE APPARATUS WITH LATERAL ARM MOVEMENT", which is incorporated by reference in its entirety.

BACKGROUND OF THE INVENTION

1. Field of the Invention

The present invention generally relates to exercise apparatuses. More specifically, the present invention generally relates to cable crossover exercise apparatuses having a weight stack and opposed extension arms.

2. Description of Related Technology

Exercise apparatuses commonly employ a weight stack actuated by a cable as it is pulled by a user. This cable can extend from the weight stack, through or along an arm, and terminate with a handle graspable by a user. Some such arrangements can present certain limitations affecting the usefulness of the exercise apparatus. For example, the range of exercises which may be performed with certain cable actuated apparatuses is sometimes limited by the effective length of cable linking the weight stack with the user. The effective useful length of the cable may be limited by the height of the weight stack; in such systems, for example, for each foot the cable is pulled by the user, the weight stack may be required to rise a proportional distance. Where the rise of the weight stack is substantially equal to the distance which the cable is pulled, the effective useful length of the cable is often limited to only a few feet since building weight stacks any larger can be cost prohibitive, or structurally undesirable.

Certain weight stack based exercise apparatuses also encounter problems as a result of the momentum created when the weight plates are lifted under the control of a cable. Specifically, when the weight plates are lifted upwardly at a fast pace, the generated momentum can create momentary reductions and increases in the perceived force encountered by the user. Such momentary changes are highly undesirable.

Some weight stack based exercise apparatuses also encounter problems with the cable catching or binding on the frame, support arms, or other parts of the assembly. Certain weight stacks also have cables that shorten or lengthen when a support arm(s) that contacts the cable moves upward or downward. Such shortening or lengthening can cause the handles coupled to the cables to inconveniently dangle an excessive distance downwardly from the support arm(s).

Other exercise apparatuses have problems because of lack of mobility of the arms and so the handles. Limiting the possible orientation of the arms can limit the degree of user arm movement. This in turn reduces the effectiveness of the workout performed by the user.

In light of the foregoing limitations, there is a continuing need for more versatile exercise apparatuses that overcome the above shortcomings.

SUMMARY OF THE INVENTION

The present invention provides an exercise apparatus that can include a support structure having a base portion and that can house a resistance assembly. At least one arm assembly can be mounted to the support structure. Each of the one or more arm assemblies can include (i) an elongate member and (ii) a mounting bracket assembly. The mounting bracket assembly can be pivotally mounted to the elongate member and also mounted to the support structure so that a portion of the mounting bracket assembly can be adjustable about a substantially vertical axis. In one embodiment, the mounting bracket assembly can be mounted to the support structure at a location spaced apart from the base portion of the support structure. One portion of the mounting bracket assembly allows the elongate member to pivot upwardly and downwardly, while another portion allows at least a portion of the mounting bracket assembly (and thus the arm assembly) to pivot inwardly and outwardly (i.e., laterally), about a substantially vertical axis. At least one cable can extend from the resistance assembly to the arm assembly.

The ability of each arm assembly to pivot both upwardly and downwardly and inwardly and outwardly (i.e., laterally) about a substantially vertical axis located adjacent to and spaced apart from the support structure greatly increases the range of motions possible for a user of the apparatus. In addition, locating the points of rotation away from the base portion of the apparatus prevents a user' feet, shoes, shoelaces or other clothing from becoming entangled in the pivot mechanisms facilitating movement of the elongate arm during adjustment.

One embodiment of the apparatus further includes a pulley assembly that can include first, second, and third guide pulleys mounted adjacent a proximal end of the at least one arm assembly. The guide pulleys can be mounted such that the third guide pulley is mounted lower than the second guide pulley, which is mounted lower than the first guide pulley. In use, an end of the cable can contact at least one of the three guide pulleys before entering a proximal end of the elongate member and exiting a distal end of the elongate member. The contact between the cable and at least one of the three pulleys can regulate tension within the cable so that cable tension does not vary substantially as the elongate member of the arm assembly pivots from an upper position to a lower position, and from an inner position to an outer position.

In one embodiment, the guide pulleys can be positioned such that when the elongate member is pivoted so that it is at a generally upward angle, the cable contacts at least the second guide pulley, and optionally the first guide pulley, depending on how steeply the elongate member is raised. When the elongate member is pivoted so that it is at a generally downward angle, the cable can contact at least the third guide pulley, and optionally the first guide pulley. The cable may contact all three guide pulleys.

The configuration of the guide pulleys ensures that the cable is properly positioned with respect to the elongate member of the respective arm assembly regardless of whether the elongate member is in an upper position or a lower position. This orientation of the guide pulleys allows the cable to move freely without binding, regardless of the orientation of the arm assembly. This orientation also minimizes the shortening or lengthening of the portion of the cable extending from the distal end of the elongate member of the arm assembly when the arm or arms are moved upwardly or downwardly.

In one configuration the mounting bracket assembly of the arm assembly can include two locking pivot plates. A first locking pivot plate can be configured and positioned to pivot and lock the elongate member in a selected position relative to the mounting bracket assembly (e.g., upwardly and downwardly), while the second locking pivot plate can be configured and positioned so that a portion of the mounting bracket assembly can pivot about a substantially vertical axis and lock the mounting bracket assembly in a selected position relative to the support frame of the apparatus (e.g., inwardly and outwardly).

The apparatus can also include at least one foot pedal located near the base portion of the support structure. The at least one foot pedal can be used to actuate a locking pin that interacts with the second pivot plate. The locking pin itself can be located adjacent a middle portion of the support structure, adjacent the second pivot plate, while the foot pedal can be located near the base of the support structure. A push rod can connect the foot pedal to the locking pin. The foot pedal can be selectively actuated, unlocking the pivot pin from the second pivot plate, and allowing a user to pivot the second pivot plate as desired, at which time the foot pedal is released, causing the locking pin to lock the second locking pivot plate in a selected position relative to the support structure.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above recited and other benefits, advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

A detailed description of the invention will now be provided with specific reference to Figures illustrating various exemplary embodiments. It will be appreciated that like structures will be provided with like reference designations, i.e. like numerical designations with different post scripts.

The present invention is directed to an exercise apparatus including a support structure having a base portion and housing a resistance assembly, such as one or more weight stacks or other structures that provide resistance to a user operating the exercise apparatus. At least one arm assembly is mounted to the support structure and receives at least one cable that extends from the resistance assembly to a handle graspable by a user. Each of the one or more arm assemblies can include: (i) an elongate member, and (ii) a mounting bracket assembly. The mounting bracket assembly can be pivotally mounted to the elongate member and mounted to the support structure so as to be adjustable about a substantially vertical axis. Mounting of the mounting bracket assembly can be at a location spaced apart from the base portion of the support structure. This mounting bracket assembly can enable the elongate member to (i) pivot upwardly and downwardly generally parallel to a vertical axis of the exercise apparatus, and/or (ii) move laterally relative to a vertical axis of a portion of the mounting bracket assembly.

The ability of each arm assembly to pivot upwardly, downwardly, and laterally relative to a portion of the support structure greatly increases the range of motions possible for a user of the apparatus. In addition, locating the arm assembly, and so the mounting bracket assembly, away from the base portion of the apparatus prevents a user' feet, shoes, shoelaces or other clothing from becoming entangled in the mechanism that facilitates movement of the arm assembly during adjustment.

Figure 1:
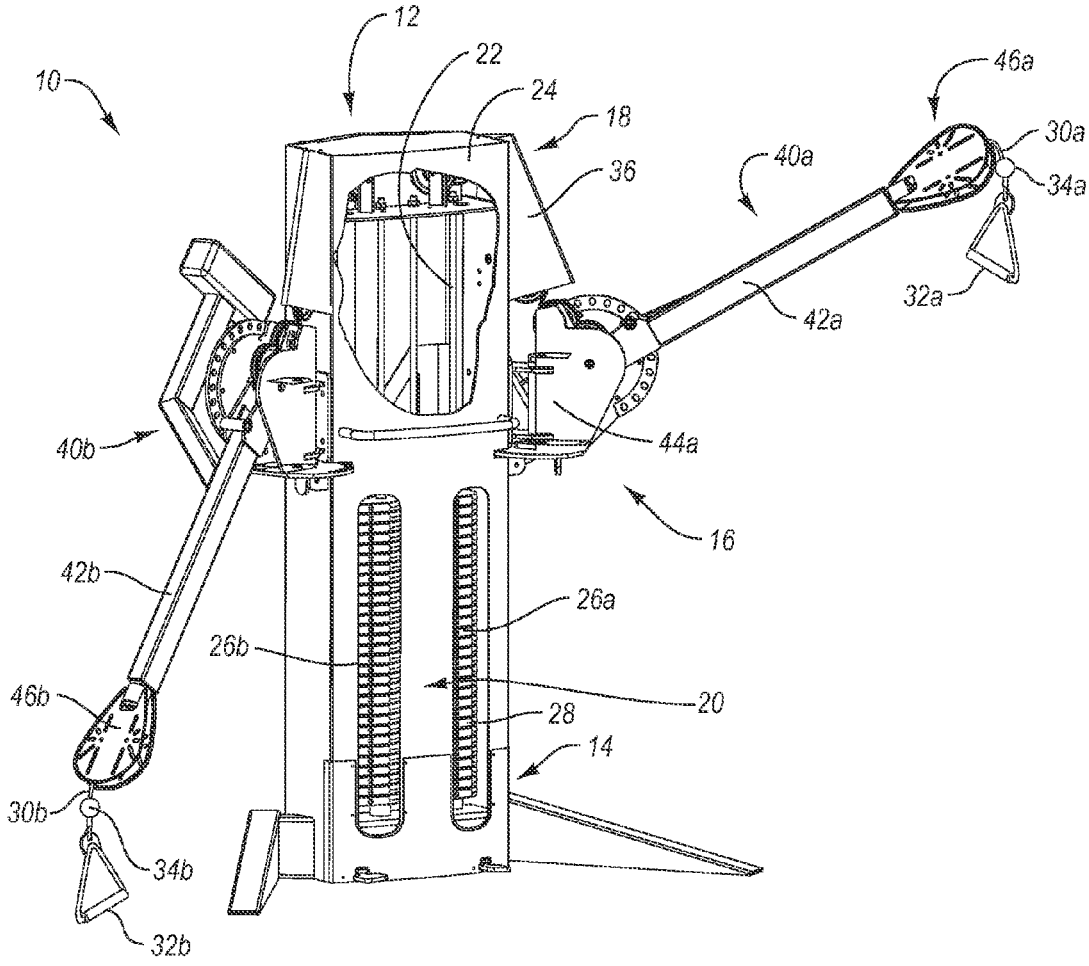
FIG. 1 is a perspective view of an exemplary exercise apparatus of the present invention.

With reference to FIG. 1, an exercise apparatus 10 is disclosed. The exercise apparatus 10 can include a support structure 12 that supports a resistance assembly 20 and two arm assemblies 40*a* and 40*b*. Extending from resistance assembly 20 and cooperating with arm assemblies 40*a* and 40*b* are one or more cables 30*a* and 30*b*. Cable 30*a* extends from resistance assembly 20, passes through portions of support structure 12, and terminates at a portion of arm assembly 40*a*, while cable 30*b* extends from resistance assembly 20, passes through portions of support structure 12, and terminates at a portion of arm assembly 40*b*.

Turning first to support structure 12, support structure 12 can have a base portion 14, a middle portion 16, and a top portion 18. In the illustrated configuration, support structure 12 includes an internal frame 22 and a housing 24 mounted to and generally surrounding internal frame 22. The internal frame 22 provides structural strength to exercise apparatus 10, while housing 24 functions as a protective cover and encloses and prevents inadvertent access to resistance assembly 20 and other components, assemblies, and mechanisms of exercise apparatus 10. It will be understood that internal frame 22 can be optionally integrally formed with housing 24. In an alternative embodiment, housing 24 may be more than a protective cover, itself providing structural strength to exercise apparatus 10.

As mentioned, supported by support structure 12 is resistance assembly 20. The resistance assembly 20 can include dual weight stack assemblies 26*a* and 26*b*. Each weight stack assembly 26*a* and 26*b* can include one or more weight plates 28 slidable along a support rod (not shown). In other configurations, however, apparatus 10 can include one or more weight stack assemblies or other structures capable of providing resistance to a user operating exercise apparatus 10. For instance, in other configurations, resistance assembly 20 can include one or more synthetic resistance bands or members, one or more fluid shocks, or other structures that resist the movement of an exercising user.

Mounted to support structure 12 are arm assemblies 40*a* and 40*b*. Discussion will be made herein to the configuration of arm assembly 40*a* and any portions of exercise apparatus 10 that interacts with and relates to arm assembly 40*a*. It will be understood that such discussion will also apply to arm assembly 40*b* and any portions of exercise apparatus 10 that interacts with and relates to arm assembly 40*b*. As identified previously, like structures will be provided with like reference designations.

As shown in FIG. 1, arm assembly 40*a* can include an elongate member 42*a*, a mounting bracket assembly 44*a* mounted to a proximal end of elongate member 42*a*, and a swivel arm assembly 46*a* located at a distal end of arm assembly 40*a*. Elongate member 42*a* can be pivotally mounted to mounting bracket assembly 44*a*, and mounting bracket assembly 44*a* can be mounted to support structure 12 so that a portion of mounting bracket assembly 44*a* pivots relative to support structure 12. The pivotal mounting of elongate member 42*a* to mounting bracket assembly 44*a* allows elongate member 42*a* to be selectively pivoted between at least an upper position and a lower position. For easy of explanation and illustration, elongate member 42*a* is show in the upper position and elongate member 44*b* of arm assembly 40*b* is shown in the lower position. It will be understood that each elongate member 42*a* and 44*b* can be positioned in the upper position, the lower position, or any available position between the upper position and the lower position. The range of motion between the upper position and the lower position can be about 165 degrees, i.e., elongate arm 42*a* traverses approximately 165 degrees when it moves from the maximum upper position to the maximum lower position. It will be understood that in other configurations, the range of motion can be greater or less than about 165 degrees.

Cable 30*a* can extend from resistance assembly 20 to arm assembly 40*a*. A proximal end of cable 30*a* can mount to support structure 12, while the distal end terminates at an optionally removable user handle 32*a* after cable 30*a* runs through a series of pulleys (FIG. 2) within support structure 12 and exits through swivel arm assembly 46*a* located at a distal end of arm assembly 40*a*. A stop 34*a* can be mounted to the distal end to prevent the distal end of cable 30*a* being drawn into swivel arm assembly 46*a* under the influence of resistance assembly 20 and maintain a portion of cable 30*a* accessible to attach user handle 32*a*.

Generally, cable 30*a* can link user handle 32*a* to resistance assembly 20, including weight stack assembly 26*a*. The combination of the pulleys and the weight stack 26*a* can provide the resistance to the exercising user as the user pulls upon user handle 32*a* and draws a portion of cable 30*a* from within support structure 12. The pulleys provide a 2:1 load ratio for a user grasping and pulling upon handle 32*a*. In this way, a one hundred fifty pound weight stack assembly 26*a* may be moved by the application of seventy five pounds force at handle 32*a* (one hundred fifty pounds total force when both handles and both weight stack assemblies are used simultaneously). The 2:1 ratio reduces the inertia of one or more weight plates 28 forming part of weight stack assembly 26*a* by reducing the rate of movement of weight plates 28 compared to the rate of travel at handle 32*a*. For example, a 2:1 ratio allows handle 32*a* to move two times faster than weight plates 28. The 2:1 ratio also allows a handle movement equal in length to two times the travel distance of weight plates 28 of weight stack assembly 26*a*. This allows extended movements, such as, for example, overhead lift and bicep curls in addition to the dead lift movements, to provide users with greater flexibility in choosing a desired resistance level. Although illustrated and described as having a 2:1 ratio, it is to be understood that any other desirable ratio may be used.

It is understood that exercise apparatus 10 at FIG. 1 also includes arm assembly 40*b* having a similar configuration to arm assembly 40*b*. As such the features and functions of a weight stack 26*b*, a cable 30*b*, and a handle 32*b*, and arm assembly 40*b*, are similar to those of weight stack 26*a*, a cable 30*a*, and a handle 32*a*, and arm assembly 40*a*. Further, although described as having two independent weight stack assemblies 26*a* and 26*b* and two cables 30*a* and 30*b*, it is to be understood that the apparatus may alternatively include a single weight stack assembly and a single cable.

Figure 2:
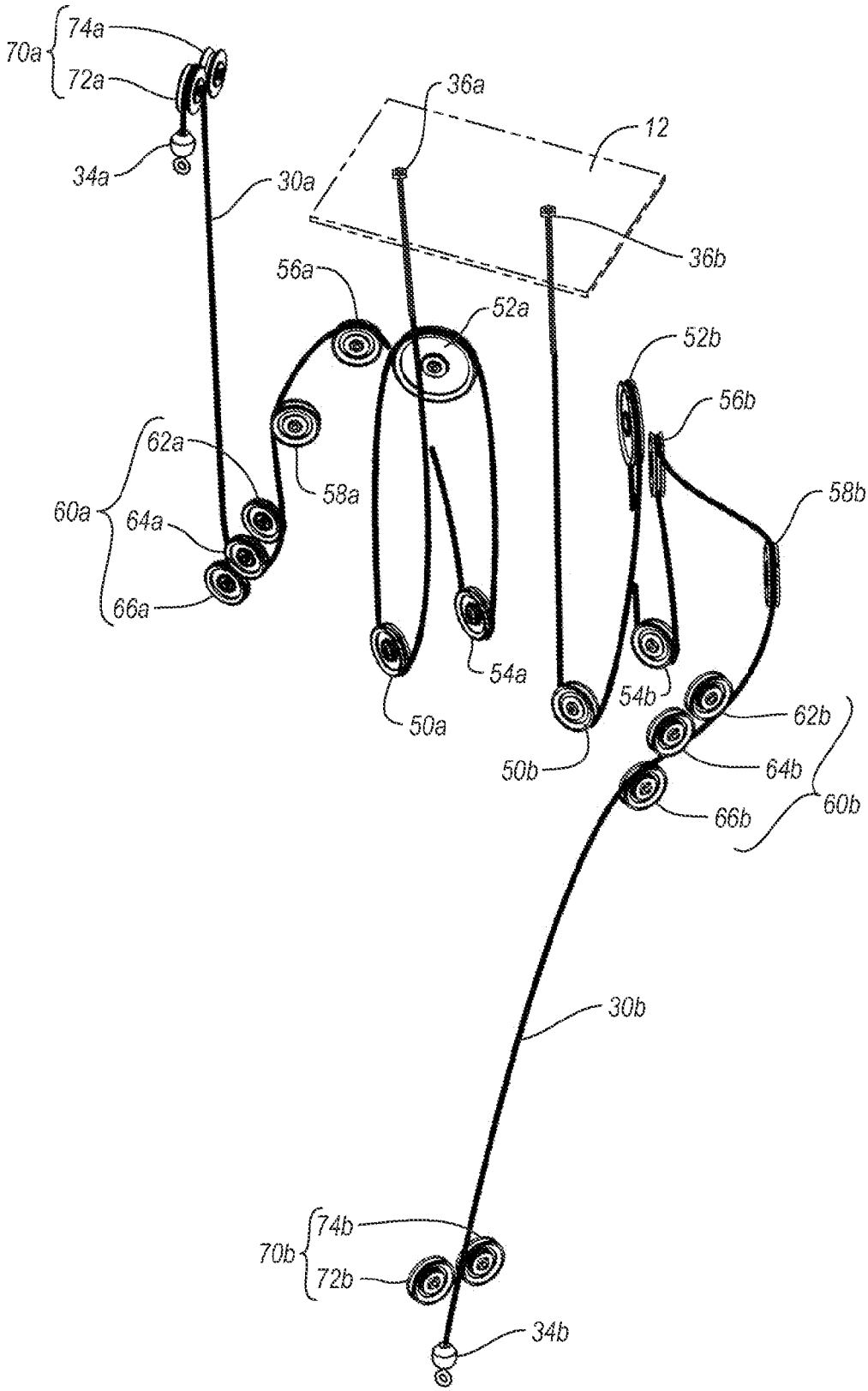
FIG. 2 is a diagram illustrating one path of the cables through the exercise apparatus of FIG. 1.

Turning to FIG. 2, illustrated are the exemplary paths for cables 30*a* and 30*b* through various pulleys within exercise apparatus 10. The illustrated paths are for the situations with elongate member 42*a* (FIG. 1) is in an upper or raised position, and cable 30*b* when elongate member 44*b* (FIG. 1) is in a lower position. The following discussion will be directed principally to the path of cable 30*a*. Since a similar discussion can be made for the path of cable 30*b*, the following discussion can also apply to the path of cable 30*b*.

As shown in FIG. 2, cable 30*a* can be terminated at a proximal end 36*a* (cable 30*b* is terminated at proximal end 36*b*) and coupled to support structure 12, such a plate or other structure, located near top portion 18 (FIG. 1). The cable 30*a* moves over one or more of a series of pulleys mounted to support structure 12 (FIG. 1). The cable 30*a* can extend from the support structure 12 and pass over a first lower pulley 50*a* associated with weight stack assembly 26*a*, a central upper pulley 52*a* disposed from first lower pulley 50*a*, a second lower pulley 54*a* associated with weight stack assembly 26*a*, and a second upper pulley 56*a*. Cable 30*a* extends from this second upper pulley 56*a* over a pulley 58*a* housed within a sleeve portion 36 of housing 24 (FIG. 1) and then over an arm pulley assembly 60*a* of arm assembly 40*a*. This arm pulley assembly 60*a* can have a first guide pulley 62*a*, a second guide pulley 64*a*, and a third guide pulley 66*a*. Dependent upon the position of elongate member 42*a* (FIG. 1) relative to support structure 12 (FIG. 1), cable 30*a* can engage or bypass third guide pulley 66*a*.

Following passing over one or more of first guide pulley 62*a*, second guide pulley 64*a*, or third guide pulley 66*a*, cable 30*a* extends towards a distal end of arm assembly 40*a*. Before exiting the distal end of arm assembly 40*a*, cable 30*a* can pass through a swivel arm pulley assembly 70*a*, having a first swivel pulley 72*a* and a second swivel pulley 74*a*, located within swivel arm assembly 46*a*, which will be described in more detail hereinafter. For instance, cable 30*a* can pass between first swivel pulley 72*a* and second swivel pulley 74*a* before exiting swivel arm assembly 46*a* (FIG. 1). Although the various pulleys are illustrated without cable guards for purposes of clarity, it is to be understood that cable guards may be included with one or more of the pulleys to maintain engagement of the cable with the pulley.

The pulleys 60*a*, 62*a*, 64*a*, are positioned such that stop 34*a* remains substantially in contact with swivel arm assembly 46*a* (FIG. 1) regardless of the position of elongate member 42*a* (FIG. 1). The pulleys 60*a*, 62*a*, 64*a* thus provide sufficient tension on cable 30*a* to prevent handle 32*a* coupled to the end of cable 30*a* from dangling excessively from elongate member 42*a*, regardless of whether elongate member 42*a* is in an upper or a lower position, and regardless of whether mounting bracket assembly 40*a* is in an inward or outward position.

As illustrated in FIGS. 1 and 2, when elongate member 42*a* of arm assembly 40*a* is located in an upper position, cable 30*a* can contact guide pulleys 62*a* and 64*a*. When elongate member 42*b* is in a lower position, cable 30*b* can contact guide pulleys 64*b* and 66*b*, bypassing pulley 64*b*. Similar engagement of cables and pulleys can occur when elongate member 42*a* is in a lower position and elongate member 42*b* is in an upper position. For instance, when elongate member 42*b* is located in an upper position, cable 30*b* can contact guide pulleys 62*b* and 64*b*, while when elongate member 42*a* is in a lower position, cable 30*a* can contact guide pulleys 62*a* and 66*a*, bypassing pulley 64*a*.

Depending on the degree of incline or decline of elongate members 42*a* and 42*b*, only guide pulley 64*a* or 66*b* may be contacted respectively. This orientation of first, second, and third guide pulleys 62*a*, 64*a*, and 66*a* (and guide pulleys 62*b*, 64*b*, and 66*b*), allows cables 30*a* and 30*b* to move freely within an interior tubular passageway (not shown) of elongate members 42*a*, 44*b* without binding regardless of the orientation of elongate members 42*a*, 42*b*. This orientation further minimizes variations in the length and tension of cables 30*a*, 30*b* as at least one of elongate members 42*a* and 42*b* is moved upwardly or downwardly. Thus, cable tension does not vary substantially as one or both of first and second elongate members 42*a* and 42*b* are moved from an upper position to a lower position.

With continued reference to FIGS. 1 and 2, resistance assembly 20 may include a perforated support rod or frame (not shown) for supporting each weight stack assembly 26*a* and 26*b*. The weight plates 28 of each weight stack assembly 26*a* and 26*b* can be mounted to the perforated support rod or frame (not shown). Inserting a locking pin (not shown) through a portion of the weight plate 28 and into a hole of the perforated support rod or frame (not shown) enables a user to select the number of weight plates 28 to be moved through movement of cable 30*a*. Other manners to support and move weight plates 28 are known to those skilled in the art.

As a user pulls upon user handle 32*a*, the movement of cable 30*a* causes movement of weight stack assembly 26*a* and controls the movement of the weight plates 28. For instance, with lower pulleys 50*a*, 54*a* mounted to a portion of the support rod or frame (not shown) though a coupling member (not shown) and the locking pin (not shown) engaged with a hole of the perforated support rod, movement of cable 30*a* moves pulleys 50*a* and 54*a* upwardly. This upward movement of pulleys 50*a* and 54*a* results in upward movement of weight plates 28 of weight plate assembly 26*a* against the force of gravity. Cable 30*b* may be connected in a similar manner in order to lift weight stack assembly 26*b*.

Although one orientation is disclosed for the various pulleys used in accordance with the present invention, those skilled in the art will readily understand that the exact orientation of the pulleys may be varied without departing from the spirit of the present invention. Additional information regarding use of the perforated support rod can be found in U.S. patent application Ser. No. 10/358,993, filed Feb. 15, 2003, and entitled "Cable Crossover Exercise Apparatus," the disclosure of which is incorporated herein by reference.

Figure 3:
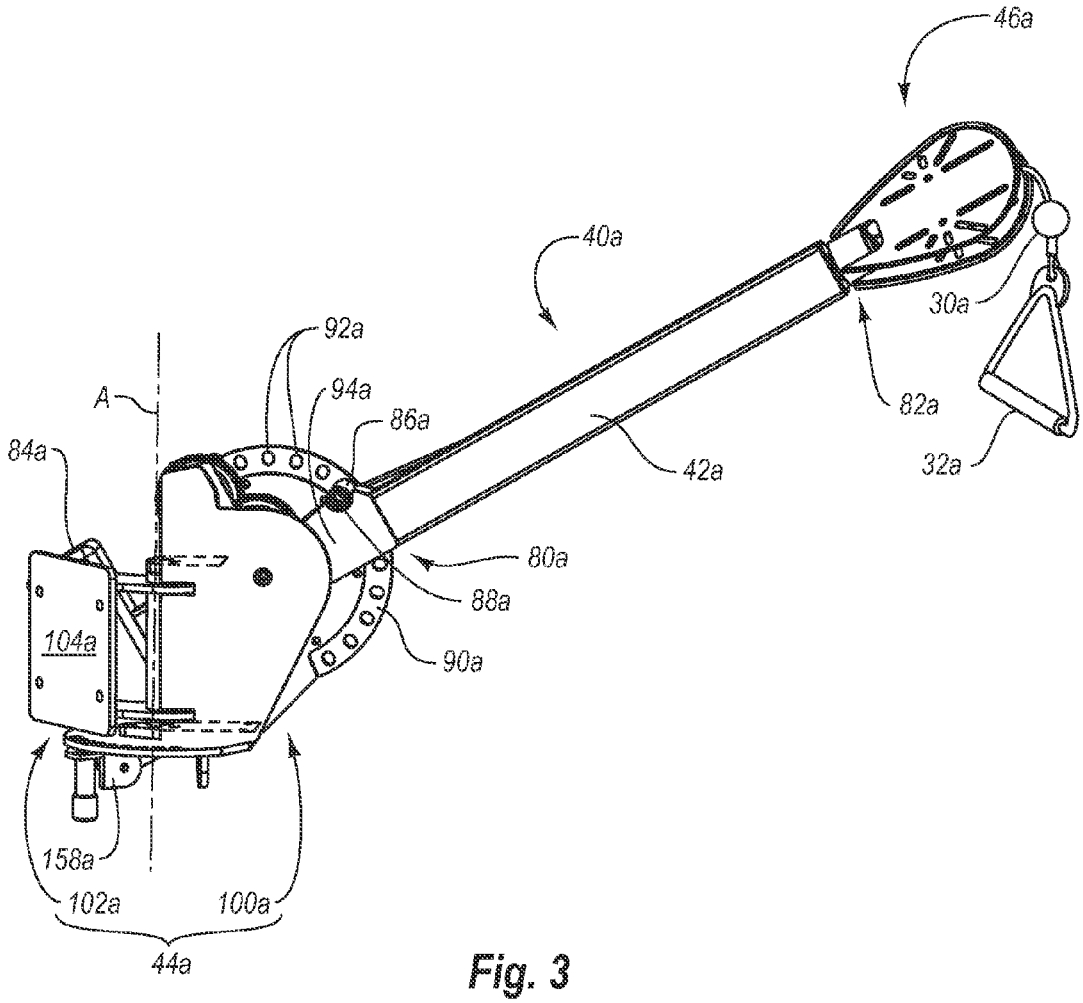
FIG. 3 is a close up perspective view of a first arm assembly of the apparatus of FIG. 1.

Turning now to FIG. 3, illustrated is one configuration of arm assembly 40*a*. The following discussion will be directed toward the configuration of arm assembly 40*a*, but a similar discussion can be provided for arm assembly 40*b*. As discussed before, arm assembly 40*a* pivotally mounts to support structure 12 (FIG. 1). The arm assembly 40*a* can include elongate member 42*a* and mounting bracket assembly 44*a*. Optionally, arm assembly 40*a* includes swivel assembly 46*a*.

Turning first to elongate member 42*a*, elongate member 42*a* has a proximal end 80*a*, a distal end 82*a*, and an interior channel (not shown) through which cable 30*a* passes. Extending from elongate member 42*a* at a location between proximal end 80*a* and distal end 82*a* is an optional counterweight 84*a*. This counterweight 84*a* can assist with movement of elongate member 42*a* during positioning for use and offset the weight and moment forces associated with swivel assembly 46*a*.

Mounted to proximal end 80*a* of elongate member 42*a* is an optional bracket 94*a* that facilitates engagement between elongate member 42*a* and mounting bracket assembly 44*a*. This bracket 94*a* can receive elongate member 42*a* and pivotally mount to mounting bracket assembly 44*a*. In this manner, a user can select a desired orientation for elongate member 42*a* relative to mounting bracket assembly 44*a* and to lock elongate member 42*a* in place. It will be understood that this bracket 94*a* and/or the general function of bracket 94*a* can be performed or incorporated within mounting bracket assembly 44*a* or elongate member 42*a*.

Extending from bracket 94*a* is a lock member 86*a*. This lock member 86*a* includes a lumen 88*a* that can receive a locking pin (not shown) to selectively fix the position of bracket 94*a* and so elongate member 42*a* relative to mounting bracket assembly 44*a*. For instance, mounting bracket assembly 44*a* can include a generally semicircular flange or pivot plate 90*a* having a plurality of holes 92*a*. The locking pin (not shown) can pass through lock member 86*a* and engage with one or more of flange holes 92*a* to selectively fix the position of bracket 94*a* and so elongate member 42*a* relative to mounting bracket assembly 44*a*. The illustrated embodiment can include twelve selectable positions for elongate member 42*a* relative to mounting bracket assembly 44*a* through use of flange 90*a* and holes 92*a*, although more or fewer positions may be provided. Further, although reference is made to flange 90*a* being semicircular, it will be understood that flange 90*a* can have various other configurations, including, but not limited to, oval, curved, polygonal, or any other configuration that enables the flange to perform the desired function.

In practice, when a user desires to change the angular orientation of the elongate member 42*a*, the locking pin (not shown) is simply removed and lock member 86*a* aligned with another hole 92*a* at which time the locking pin is once again inserted in position to lock elongate member 42*a* relative to mounting bracket assembly 44*a*.

Generally, mounting bracket assembly 44*a* enables elongate member 42*a* to move in a number of different planes so that a user can select various different orientations for use in performing various exercises. The inclusion of flange 90*a* aids with movement of elongate member 42*a* upwardly and downwardly. This flange 90*a* can form part of a pivot assembly 100*a* of mounting bracket assembly 44*a*. A mounting assembly 102*a* can also form part of mounting bracket assembly 44*a*. The pivot assembly 100*a* and mounting assembly 102*a* work together to enable elongate member 42*a* to move upwardly, downwardly and laterally relative to support structure 12 (FIG. 1). For instance, pivot assembly 100*a* facilitates upward and downward movement of elongate member 42*a*, while the combination of pivot assembly 100*a* and mounting assembly 102*a* facilitates lateral movement of elongate member 42*a*. The mounting assembly 102*a* also provides a mounting structure 104*a* though which mounting bracket assembly 44*a* mounts to support structure 12 (FIG. 1).

Figure 4:
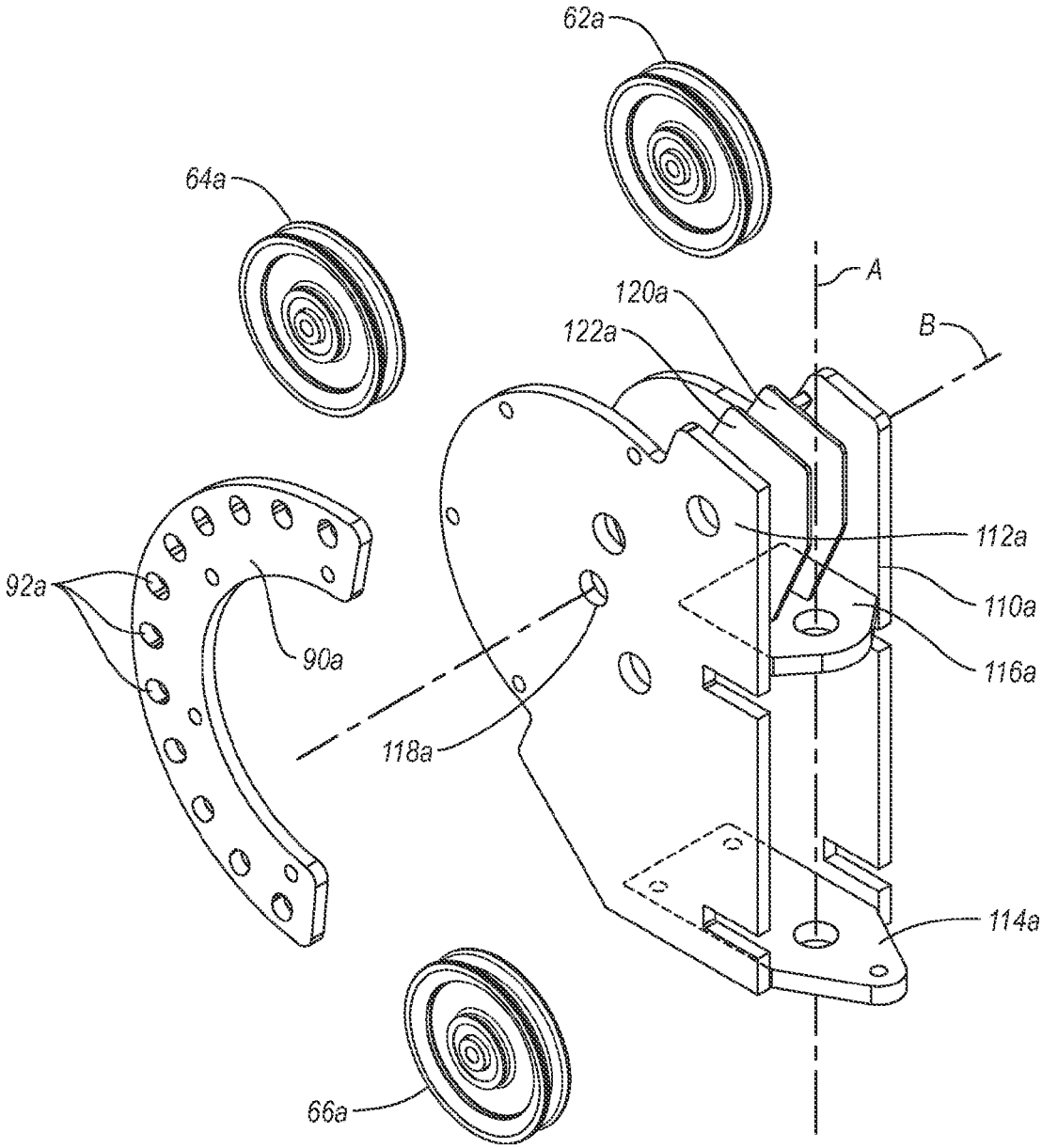
FIG. 4 is an exploded close up view of a portion of a mounting bracket assembly of the exercise apparatus of FIG. 1.

FIG. 4 illustrates an exploded configuration of pivot assembly 100*a*. Two members 110*a* and 112*a* spaced apart by pivot supports 114*a* and 116*a* form pivot assembly 100*a*. The pivot supports 114*a* and 116*a* provide an axis of rotation, identified by the letter A, for elongate member 42*a* (FIG. 3) to move laterally relative to support structure 12 (FIG. 1). A second axis of rotation, identified by letter B, can be provided by holes 118*a* in each of members 110*a* and 112*a*. This second axis of rotation enables elongate member 42*a* (FIG. 3) to move upwardly and downwardly relative to mounting bracket assembly 44*a* (FIG. 3).

Member 110*a* of pivot assembly 100*a* can receive flange 90*a*, while pulleys 62*a*, 64*a*, and 66*a* can mount to one or both of members 110*a* and 112*a*. To aid with guiding cable 30*a* and supporting one or more of pulleys 62*a*, 64*a*, and 66*a*, two interior mounting plates 120*a* and 122*a* can be provided.

As indicated above, the combination of pivot assembly 100*a* and mounting assembly 102*a* facilitates lateral movement of elongate member 42*a* (FIG. 3). Stated another way, the combination of pivot assembly 100*a* and mounting assembly 102*a* enables elongate member 42*a* (FIG. 3) to rotate about the axis of rotation B. This axis of rotation is spaced apart from support structure 12 (FIG. 1). To achieve this, mounting assembly 102*a* can include mounting structure 104*a* and pivot member 130*a*. It will be understood, however, that pivot member or plate 130*a* can be considered either as part of or separate from mounting assembly 102*a*.

In the illustrated configuration, mounting structure 104*a* can be a plate that mounts to support structure 12. Extending from this plate are two flanges 134*a* and 136*a* that support a generally cylindrical member 138*a*. This cylindrical member 138*a* can receive a pivot shaft 140*a* and associated rings 142*a*, washers 144*a*, bearings 146*a*, and other components known to those skilled in the art to enable rotational motion of pivot assembly 102*a* relative to cylindrical member 138*a*. The pivot shaft 140*a* engages with pivot structures 114*a* and 116*a* (FIG. 4) and a hole 150*a* in pivot member 130*a* so that pivot assembly 102*a* can rotate about pivot shaft 140*a*.

Figure 5:
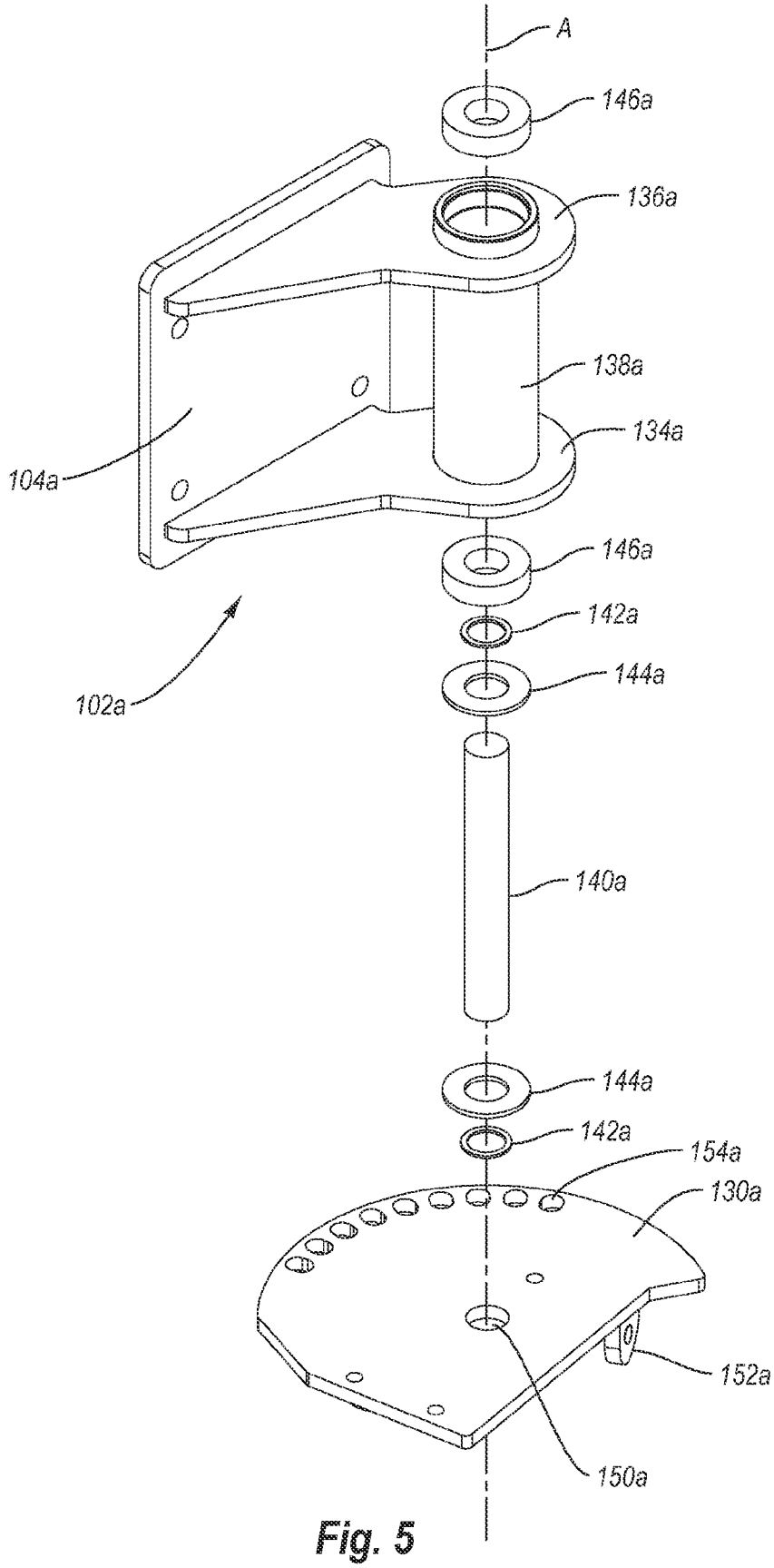
FIG. 5 is an exploded close up view of another portion of the mounting bracket assembly of FIG. 4.

With continued reference to FIG. 5, pivot member 130*a* functions in a similar manner to flange 90*a*, but controls the position of elongate member 42*a* (FIG. 3) about axis of rotation A rather than the position of elongate member 42*a* FIG. 3) about axis of rotation B. To provide the desired function, pivot member 130*a* mounts to pivot support 114*a* by way of one or more mechanical fasteners or other manners of mounting one structure to another can be used, including, but not limited to, friction fit techniques, chemical bond, welding, or other technique.

Figure 6:
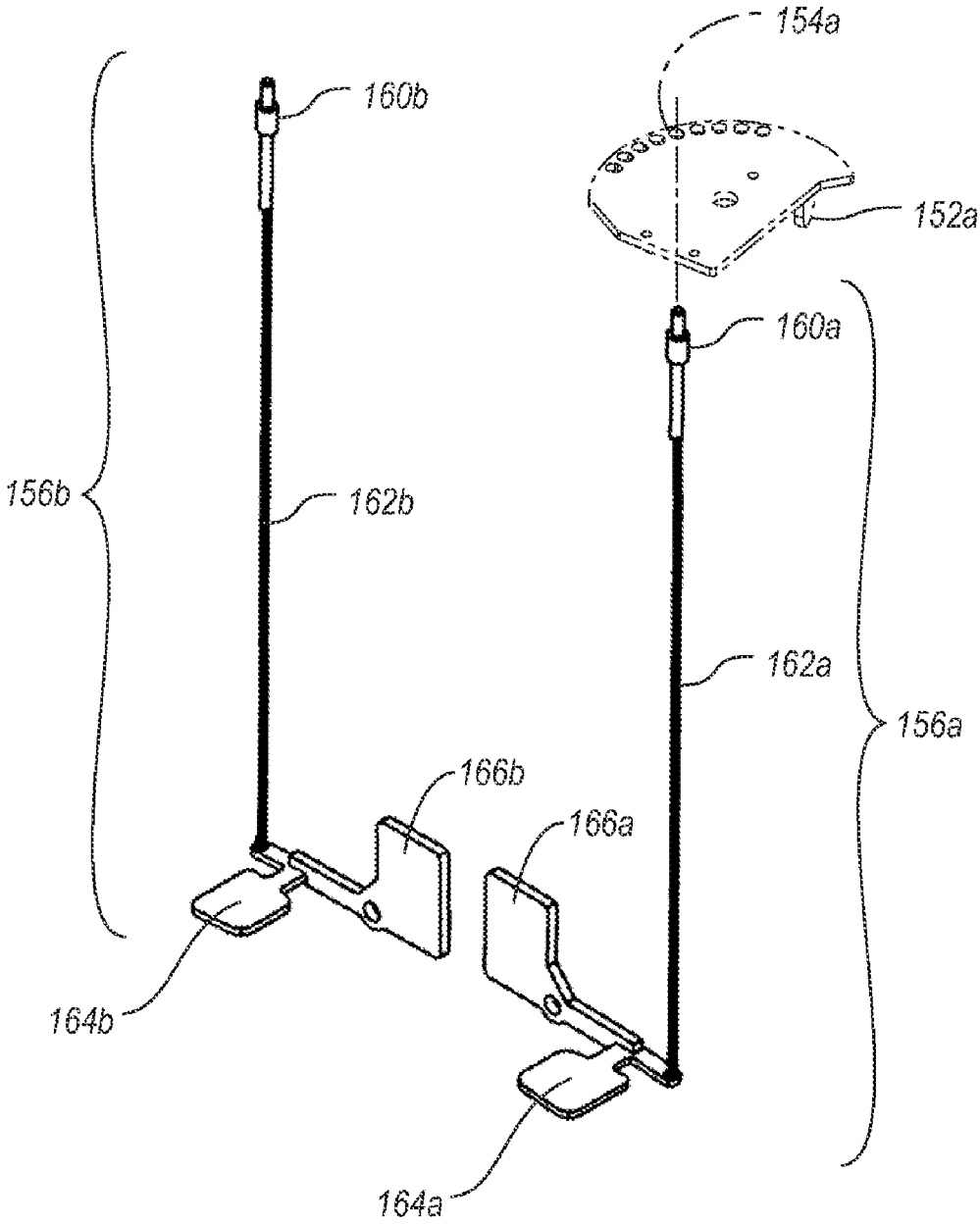
FIG. 6 is a diagram illustrating a portion of a locking mechanism usable with the mounting bracket assembly of FIG. 5 of the exercise apparatus of FIG. 1.

To enable variability in the position of elongate member 42*a* (FIG. 3), pivot member 130*a* can include a plurality of holes 154*a* that engage with a locking mechanism 156*a*, as illustrated in FIG. 6. The locking mechanism 156*a* is operable by a user' foot so that the user' hands are free to orientate pivot assembly 100*a* (FIG. 3) relative to mounting assembly 102*a* (FIG. 3). It will be understood that there is a similar locking mechanism 156*b* for orientating the pivot assembly corresponding to arm assembly 40*b*. It should be understood that in an alternate configuration, a single pedal can be used to engage both locking mechanisms of exercise apparatus 10 (FIG. 1).

To prevent over rotation or unwanted lateral movement of arm assembly 40*a*, a flange 152*a* extends from pivot member 130*a*. This flange 152*a* can contact a stop 158*a* (FIG. 3) of support structure 12 (FIG. 1) to limit movement of pivot member 130*a*. For instance, as arm assembly 40*a* moves in a clockwise direction, flange 152*a* can contact stop 158*a* to prevent additional rotational motion or lateral movement. This can be considered the maximum rotation or lateral movement about rotation of axis A in one direction. The maximum rotation or lateral movement about rotation of axis A in the other direction can, in part, be controlled by the position of counterweight 84*a* and its contact with support structure 12 (FIG. 1). The range of movement of arm assembly 42*a* about rotation of axis A from the maximum rotation in one direction to the maximum rotation in the other direction can be about 82 degrees. It will be understood that ranges of motion greater or lesser than about 82 degrees are also possible. For instance, alternating the position of flange 152*a* and stop 158*a* can vary the range of motion. It will be understood that flange 152*a* could also contact another stop or the opposite side of stop 158*a* to prevent over rotation or unwanted lateral movement. One skilled in the art can identify various other ways of preventing the unwanted movement.

In the illustrated configuration, locking mechanism 156*a* can include a locking pin 160*a* disposed atop a push member 162*a*. The push member 162*a* is in turn mounted to a foot pedal 164*a* mountable to base portion 14 (FIG. 1) of support structure 12 (FIG. 1). Since foot pedal 164*a* is pivotally mounted to base portion 14 (FIG. 1), depressing foot pedal 164*a* causes push member 162*a* to move toward base portion 14 (FIG. 1) and removes locking pin 160*a* from engagement with one of holes 154*a*. This allows a user to pivot at least a portion of mounting bracket assembly 42*a* with respect to support structure 12 (FIG. 1). Once the desired orientation of arm assembly 40*a* is achieve, the user can release foot pedal 164*a* and allow locking pin 160*a* to engage with one of holes 154*a*. More specifically, a counter weight 166*a* of foot pedal 164*a* moves under gravity and because of the pivoted mounting of foot pedal 164*a* to support structure 12 (FIG. 1), causes movement of push member 162*a* upwardly to engage lock pin 160*a* with pivot member 130*a*. With this configuration, the locking mechanism 156*a* is biased to engage lock pin 160*a* with pivot member 130*a*. This provides a safety factor to use of exercise apparatus 10 (FIG. 1). It will be understood that locking mechanism 156*a* can include biasing openings, coils, fluid shocks, or other devices to maintain lock pin 160*a* in engagement with pivot member 130*a*, until foot pedal 164*a* or other devices is actuated by the user of exercise apparatus 10.

The illustrated embodiment includes nine selectable positions for positioning a portion of mounting bracket assembly 44*a* about axis of rotation A. It will be understood that any number of positions may be possible by increasing or decreasing the number of available holes in pivot member 130*a*, i.e., holes 154*a*.

Figure 7:
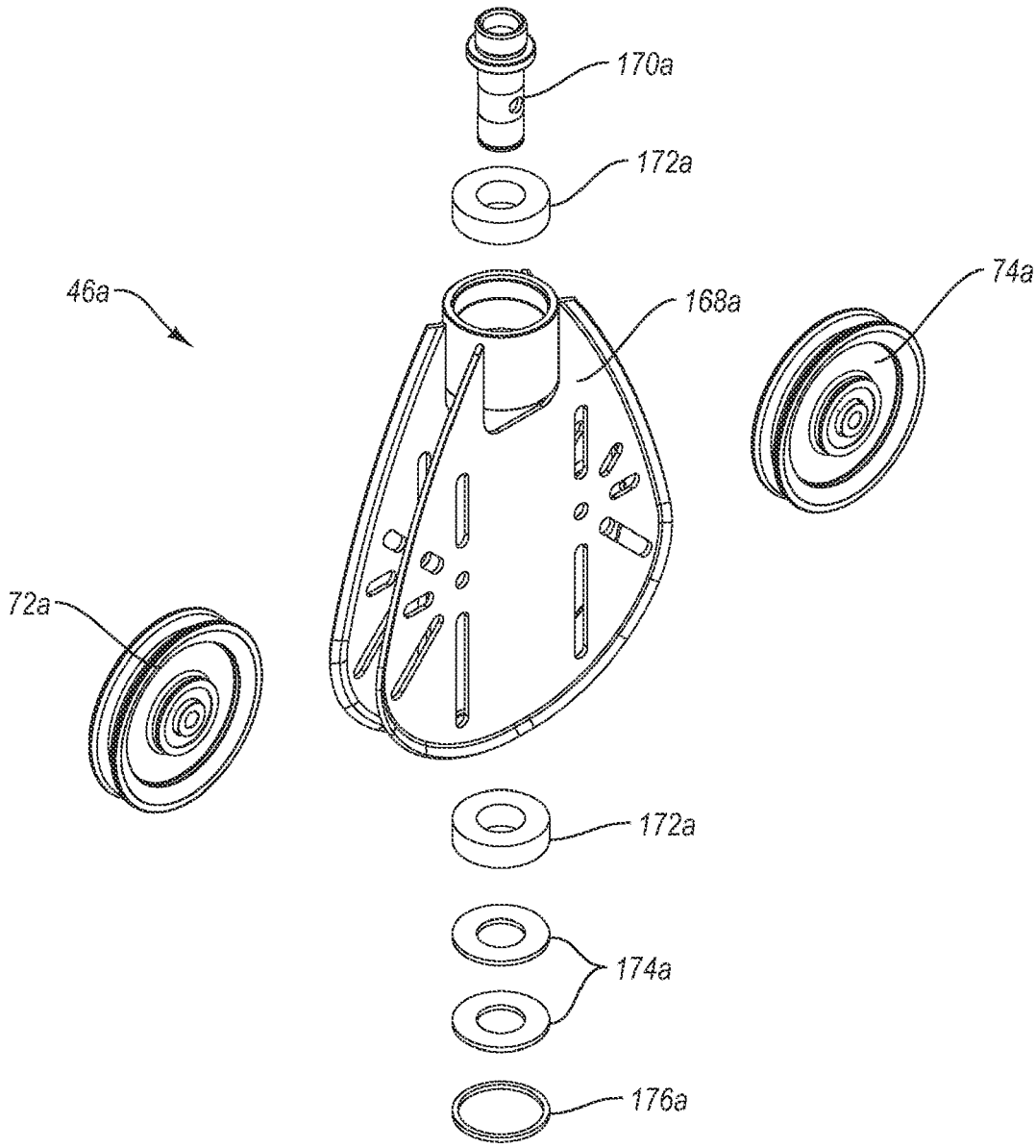
FIG. 7 is an exploded close up view of a swivel arm assembly of the first arm assembly of FIG. 3 of the exercise apparatus of FIG. 1.

FIG. 7 illustrates an exploded view of swivel arm assembly 46*a*. The assembly 46*a* includes a swivel arm 168*a* and two pulleys 72*a* and 74*a*. Swivel arm 168*a* is fitted with a trunnion 170*a*, a pair of pivot pulley bearings 172*a*, washers 174*a*, and a retainer ring 176*a*. The pivot pulley bearings 172*a* provide an opening through which cable 30*a* (FIG. 3) passes as it extends from its respective elongate member 42*a* (FIG. 3) through swivel arm assembly 46*a*. The cable 30*a* (FIG. 3) extends and exits between pulleys 72*a* and 74*a*. In this way, cable 30*a* (FIG. 3) contacts at least one of the pulleys 72*a* and 74*a* no matter the position of elongate member 40*a*, providing greater freedom of motion as an individual attempts to draw cable 30*a* in various directions during exercise.

With reference to FIG. 3, since swivel arm assembly 46*a* permits a great degree of flexibility with regard to the angle at which cable 30*a* is drawn from elongate member 42*a*, the inclusion of swivel arm assembly 46*a* at the distal end of each of elongate member 42*a* greatly increases the flexibility of the present exercise apparatus.

As mentioned throughout, the present invention has been described generally with respect to arm assembly 40*a* and those portions of exercise apparatus 10 that cooperate with arm assembly 40*a*. It will be understood that the description contained herein also applies to arm assembly 40*b* and those portions of exercise apparatus 10 that cooperate with arm assembly 40*b*. Additional information regarding the features and functions of the exercise apparatus can be found in co-pending U.S. patent application Ser. No. 10/358,993, filed 02/05/2003, and entitled "Cable Crossover Exercise Apparatus", the disclosure of which is incorporated herein by this reference.

It will be appreciated that the present invention can be embodied in a variety of different configurations and it may be possible to use a number of different materials to fabricate the exercise apparatus. For instance, metals, composites, synthetic materials, natural materials, or other materials can be used so long as the materials have the properties that enable the particular component, assembly, mechanism, etc. to perform the described function.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise apparatus comprising:

a support structure supporting a resistance assembly and having a base portion;

first and second arm assemblies mounted to said support structure at a middle portion spaced apart from said base portion, at least a portion of each of said arm assemblies being movable laterally relative to said support structure; and at least one cable extending from said resistance assembly to said arm assemblies, wherein an elongate member of each arm assembly is selectively pivotable in a first plane between an upper position and a lower position; and is selectively pivotable in a second plane between an inner position and an outer position, and further comprising at least one foot pedal located adjacent said base portion of said support structure for actuating a locking pin that engages a locking pivot plate of at least one of said arm assemblies so as to selectively enable at least one of the elongate members to be moved relative to the support structure between the inner and outer position and locked in a desired position, said locking pin and said locking pivot plate being disposed adjacent said middle portion of said support structure away from the base portion, a push member coupling said foot pedal at said base portion to said locking pin at said middle portion, the locking pin being disposed atop the push member, an opposite end of the push member being mounted to the foot pedal at the base portion of the support structure, such that the length of the push member extends from the base portion to the middle portion of the support structure adjacent the arm assemblies, the entire length of the push member extending between the foot pedal at the base portion and the locking pin at the middle portion being enclosed within a housing of the support structure.

2. An exercise apparatus as recited in claim 1, wherein each arm assembly further comprises a mounting bracket assembly mounted to said support structure and an elongate member pivotally mounted to said mounting bracket assembly.

3. An exercise apparatus as recited in claim 1, wherein each arm assembly further comprises a mounting bracket assembly mounted to said support structure, at least a portion of said mounting bracket assembly being movable about a substantially vertical axis.

4. An exercise apparatus as recited in claim 1, wherein each arm assembly further comprises a pivot assembly and a mounting assembly, said mounting assembly being mounted to said support structure and said pivot assembly being movable relative to said mounting assembly.

5. An exercise apparatus as recited in claim 4, wherein an elongate member is pivotally mounted to said pivot assembly.

6. An exercise apparatus comprising:

a support structure supporting a resistance assembly and having a base portion;

a first arm assembly mounted to said support structure at a middle portion spaced apart from said base portion, said first arm assembly being movable about a first axis that is generally parallel to a longitudinal axis of said support structure;

a second arm assembly mounted to said support structure at a middle portion spaced apart from said base portion, said second arm assembly being movable about a second axis that is generally parallel to said longitudinal axis of said support structure; and at least one cable extending from said resistance assembly to said at least one arm assembly, wherein an elongate member of each arm assembly is selectively pivotable in a first plane between an upper position and a lower position; and is selectively pivotable in a second plane between an inner position and an outer position, and further comprising first and second foot pedals located adjacent said base portion of said support structure for actuating a locking pin that engages a corresponding locking pivot plate of a corresponding one of said arm assemblies, selectively enabling respective first and second arm assemblies to be moved relative to the support structure between the inner and outer position, and locked in a desired position, said locking pin and said locking pivot plate being disposed adjacent said middle portion of said support structure away from the base portion;

a push member coupling each foot pedal at said base portion to a corresponding locking pin at said middle portion, each locking pin being disposed atop the push member, an opposite end of the push member being mounted to the foot pedal at the base portion of the support structure, such that the length of the push member extends from the base portion to the middle portion of the support structure adjacent the arm assemblies, the entire length of each push member extending between a corresponding foot pedal at the base portion and the corresponding locking pin at the middle portion being enclosed within a housing of the support structure.

7. An exercise apparatus as recited in claim 6, wherein each of said first arm assembly and said second arm assembly comprises a mounting bracket assembly mounted to said support structure and an elongate member pivotally mounted to said mounting bracket assembly.

8. An exercise apparatus as recited in claim 7, wherein said mounting bracket assembly further comprises a pivot assembly and a mounting assembly, said mounting assembly mountable to said support structure and said pivot assembly being movable relative to said mounting assembly.

9. An exercise apparatus as recited in claim 8, wherein said elongate member is pivotally mounted to said pivot assembly.

10. An exercise apparatus as recited in claim 6, wherein said first axis and said second axis are each a substantially vertical axis.

11. An exercise apparatus comprising:

a support structure housing a resistance assembly and having a base portion, a top portion, and a middle portion;

at least one arm assembly mounted to said support structure, said at least one arm assembly comprising (i) an elongate member and (ii) a mounting bracket assembly, said mounting bracket assembly being pivotally mounted to said elongate member and at least a portion of said mounting bracket assembly being movable relative to said middle portion of said support; and at least one cable extending from said resistance assembly to said at least one arm assembly, wherein said elongate member is pivotally mounted to said mounting bracket assembly such that: (i) said elongate member is selectively pivotable in a first plane between an upper position and a lower position; and (ii) at least a portion of said mounting bracket assembly is selectively pivotable in a second plane between an inner position and an outer position, wherein said mounting bracket assembly comprises: (i) a first locking pivot plate for pivoting and locking said elongate member in a selected position relative to a first portion of said mounting bracket assembly, and (ii) a second locking pivot plate for pivoting and locking a portion of said mounting bracket assembly in a selected position relative to said support structure, and further comprising at least one foot pedal located adjacent said base portion of said support structure for actuating a locking pin that engages said second locking pivot plate, said locking pin being operable to lock said second locking pivot plate of said mounting bracket assembly in a selected position relative to said support structure, said locking pin and said second locking pivot plate being disposed adjacent said middle portion of said support structure away from the base portion;

wherein a push member couples said foot pedal at said base portion to said locking pin at said middle portion, the locking pin being disposed atop the push member, an opposite end of the push member being mounted to the foot pedal at the base portion of the support structure such that the length of the push member extends from the base portion to the middle portion of the support structure adjacent the arm assembly, the entire length of the push member extending between the foot pedal at the base portion and the locking pin at the middle portion being enclosed within a housing of the support structure.

12. An exercise apparatus as recited in claim 11, wherein said at least one arm assembly further comprises first, second, and third guide pulleys mounted adjacent a proximal end of the at least one arm assembly.

13. An exercise apparatus as recited in claim 12, wherein said third guide pulley is mounted at a first location closer to said base portion than said second guide pulley and said second guide pulley is mounted at a second location that is closer to said base portion than said first guide pulley.

14. An exercise apparatus as recited in claim 13, wherein an end of said at least one cable contacts at least one of said first, second, and third guide pulleys, and then enters a proximal end of said elongate member and exits through a distal end of said elongate member such that cable tension does not vary substantially as said elongate member of said arm assembly is pivoted from an upper position to a lower position.

15. An exercise apparatus as recited in claim 14, wherein when said elongate member is in a raised position, an end of said cable passes around and contacts said first guide pulley and said guide second pulley before passing into an opening of said elongate member, and when said elongate member is in a lowered position, an end of said cable passes around and contacts said first guide pulley and said third guide pulley before passing into an opening of said elongate member.

16. An exercise apparatus as recited in claim 11, wherein said first locking pivot plate provides for pivoting and locking said elongate member in the first plane between an upper position and a lower position, and said second locking pivot plate provides for pivoting and locking said elongate member between an inner position and an outer position, and wherein said second locking pivot plate is disposed below said first locking pivot plate.

* * * * *

UNITED STATES PATENT AND TRADEMARK OFFICE

CERTIFICATE OF CORRECTION

PATENT NO. : 7,601,105 B1
APPLICATION NO. : 11/178715
DATED : October 13, 2009
INVENTOR(S) : Gipson, III et al.

It is certified that error appears in the above-identified patent and that said Letters Patent is hereby corrected as shown below:

On the Title Page
Item (56) page 4, Line 48, change "(1 pages)" to --1 page--

Column 1
Line 53, change "so" to --thus--

Column 4
Line 17, change "so" to --thus--
Line 18, change "user'" to --user's--

Column 5
Line 12, change "easy" to --ease--
Line 13, change "show" to --shown--
Line 14, change "44b" to --42b--
Line 16, change "44b" to --42b--

Column 6
Line 7, change "44b" to --42b--
Line 45, change "60a, 62a, 64a" to --62a, 64a and 66a--
Line 48, change "60a, 62a, 64a" to --62a, 64a and 66a--
Line 59, change "64b" to --62b--

Column 9
Line 37, change both instances of "user'" to --user's--
Line 37, change "orientate" to --orient--
Line 40, change "orientating" to --orienting--

Column 10
Line 15, change "achieve" to --achieved--
Line 23, change "to" to --in the--

Signed and Sealed this

Eighth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,601,105 B1
APPLICATION NO. : 11/178715
DATED : October 13, 2009
INVENTOR(S) : Gipson, III et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 974 days.

Signed and Sealed this

Fifth Day of October, 2010

David J. Kappos

David J. Kappos
*Director of the United States Patent and Trademark Office*